United States Patent [19]

Hamann

[11] 4,352,097

[45] Sep. 28, 1982

[54] ANTI-THEFT SYSTEM FOR VALUABLE TRANSPORT

[76] Inventor: Walter Hamann, Kreillerstrasse 52, D-8000 München 80, Fed. Rep. of Germany

[21] Appl. No.: 178,087

[22] Filed: Aug. 14, 1980

[30] Foreign Application Priority Data

Aug. 22, 1979 [DE] Fed. Rep. of Germany ..... 2933893

[51] Int. Cl.[3] ..... G08B 13/22

[52] U.S. Cl. ..... 340/571; 340/539; 340/572

[58] Field of Search ..... 340/571, 572, 539

[56] References Cited

U.S. PATENT DOCUMENTS

| | | | |
|---|---|---|---|
| Re. 27,618 | 4/1973 | Robeson | 340/571 |
| 3,618,067 | 11/1971 | DeVale et al. | 340/571 |
| 4,023,138 | 5/1977 | Ballin | 340/539 |

FOREIGN PATENT DOCUMENTS

| | | | |
|---|---|---|---|
| 2647453 | 4/1978 | Fed. Rep. of Germany | 340/571 |

*Primary Examiner*—Glen R. Swann, III

*Attorney, Agent, or Firm*—Balogh, Osann, Kramer, Dvorak, Genova & Traub

[57] ABSTRACT

An anti-theft system for the protection of a bag of papermoney or the like being transported from a bank safe to a waiting valuables transport vehicle, having a security apparatus for marking or otherwise making useless the papermoney or for giving an alarm in the case of attempted theft. At least one stationary transmitting unit is used for radiating radio waves along the path of transport for being received by a receiving unit on the money bag. The security apparatus is put into operation when the receiving unit no longer receives an agreed information pattern from the transmitting unit, which undergoes comparison with information regenerated at the same data rate from a shift register at the container.

In one form of the system, the information to be transmitted and to undergo comparison is produced by the transmitting end and stored sequentially in solid-state memories at a high data rate at the transmitting and receiving ends of the system before each transport operation. Then, on transport, synchronized readout of the information from the memories takes place at a lower data rate for comparison, the security apparatus being put into operation if the transmitted signal is no longer received, this being sensed because of the effect on the comparison operation.

In a further form of the system the memories are read only memories which may be exchanged for security purposes.

17 Claims, 6 Drawing Figures

ANTI-THEFT SYSTEM FOR VALUABLE TRANSPORT

BACKGROUND OF THE INVENTION

The present invention relates to an anti-theft system for valuables in a container while being transported over a given short path or distance, and, more specially, in the form of a money bag between a banksafe and a waiting money transporter, having an apparatus for marking or destruction of the valuables in the container and/or giving an alarm signal in the case of any attempt at theft.

The transport of banknotes or other valuables is undertaken presently using special-purpose vehicles having a great number of security systems. Furthermore the custody of the valuables, such as banknotes and the like, and the filling up and emptying of the transport containers takes place in rooms with a full range of security measures.

However, in the chain of such security measures there is the weak link in the part of the transport process for taking the filled containers out of the rooms in which they are filled to the transport vehicle and taking the containers, before emptying, from the transport vehicle into the room in which they are emptied. In this part of the transport path, security is completely in the hand of human beings, that is to say the messengers responsible for handling the transport containers at this stage. While it is true that the transport containers used are designed for making the valuables in them useless by marking them or by destruction in the case of attack, and furthermore they are designed for giving an alarm signal, the putting into operation of these security system in the transport containers has to be undertaken by the messenger or guard so that there is the danger of such an alarm signal not being given because of a hold-up, of blackmail or because of a conspiracy.

Short Outline of the Invention

One purpose of the present invention is that of designing a monitoring system for such transport paths so that the safety of transport of such paths is automatic, that is to say not dependent on human beings.

This is suprisingly made possible because at least one stationary transmitter is used for transmitting to the container (on being transported along the path), to a receiver present in or on the container [a receiver is present], and an apparatus is put into operation by the output signal of the receiver when it is not receiving an agreed information pattern radiated by the transmitter.

Details of preferred working examples of the invention, are given in the detailed description below.

The system of the invention is designed so that it may be used with different forms of transport paths without being thereby made more complex, and without any shortcomings.

The system of the invention may be defined, from this point of view, at least in one respect, to be a further development of system parts which have so far been designed for giving security to such transport operations and making use of such apparatus. For this reason, it becomes possible to provide a very high level of security using a generally simple and uncomplex apparatus.

BRIEF DESCRIPTION OF THE DRAWINGS

A description will now be given of the invention in the form of some working examples as illustrated in the figures of the drawings.

DETAILED DESCRIPTION OF WORKING EXAMPLES OF THE INVENTION

Figure 1:
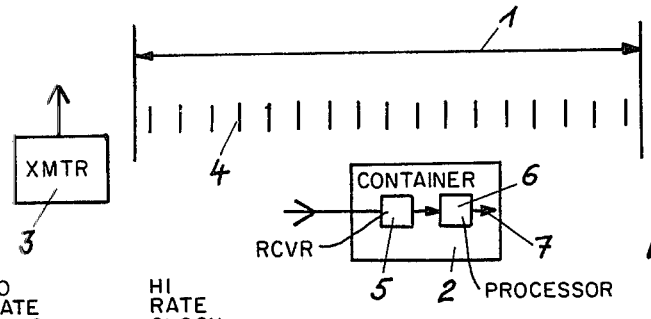
FIG. 1 is a diagrammatic view to make clear the general teaching of the present invention.

The general teaching and idea of the present invention will now be made clear using FIG. 1.

The transport path to be protected is marked by the two-headed arrow 1 and along it container 2 is transported with valuables in it. The transport path 1 may, for example, be in the courtyard of a banking organization and will be the way from the outside door of the bank to a motor vehicle in which the valuables are to be placed. However, generally speaking, the transport path may be by way of public streets and squares or, lastly, it may be through rooms within the bank itself, that is to say from the room in which the container 2 is filled (or emptied) with valuables, (as for example banknotes), to the street door of the building.

The stationary transmitting system 3 is responsible for producing a high frequency field 4, covering, by the use of an antenna and reflector line-up, the complete transport path 1. Such a transmitter unit may be designed using parts and systems as presently on the market. Inside the building itself use may be made of experience with respect to room security using high frequency radiation. Outside the building mirror systems or the like may be used to make certain that the high frequency field is limited to the path used for transport of the valuables.

As the reader will be able to see by the broad wording used for covering or defining the general teaching of the present invention, information transmission from the start to the end of the security operation may take place using different forms of energy such as high frequency radio waves, ultrasonic waves and light, as for example infrared light.

In the following description high frequency transmission is the preferred form of energy for information transmission. When other forms of energy are used for transmission operations, most of the parts of the system will stay the same as described and detailed herein and it will only be the transmitter, receiver, antenna and reflectors which will have to be changed in design to be in line with the form of the energy transmitted in the special case on hand.

Inside buildings and in the case of outdoor transport paths going round corners or with buildings between parts thereof and the transmitter, use may well be made of relay stations made up of a receiver and a transmitter with the necessary antennas. Such relay stations may be present at fixed positions along the transport path or distance, although, furthermore, they may themselves be transported, for example on the transport vehicle so that they may be ready for operation when the vehicle is unloaded.

One possible way of distribution, which may be used with all forms of transmission, within the building, makes use of known methods for transmitting information. The public electricity line in the building is used for transmission of the information coming from the transmitting unit and, at the desired positions along the transport path, transmitters are associated with the outlets or the like of the electricity line directly so as to be supplied not only with operation power, but furthermore with the information to be transmitted from the electricity line.

It is taken to be the case here that container 2 has a security apparatus by which, in the case of a hold-up or the like, the valuables to be protected within the container are marked making them useless.

The security apparatus may, however, be responsible for complete destruction of the valuables and/or operation of an alarm unit in container 2 so that the purpose of the attack or of the other form of theft is thwarted. Such forms of security apparatus are old in the art and are generally so designed that they are necessarily put into operation by hand by the person using container 2 in case of danger. The shortcomings of this form of system have been noted earlier in the present specification as well.

The security apparatus may furthermore be in the form of a tell-tale transmitter, so that the position of the container may be made out using high frequency direction finding systems without this coming to the attention of the thief.

As will be seen from FIG. 1, the container 2 has, in addition a receiver 5 and antenna, as part of the present invention. The high frequency signal received by receiver 5 is processed in processing unit 6, which may, as well, have a demodulation stage so that at the output 7 of processing unit 6 there will then be an instruction for starting the operation, or suppressing the operation of such security apparatus.

Figure 2:
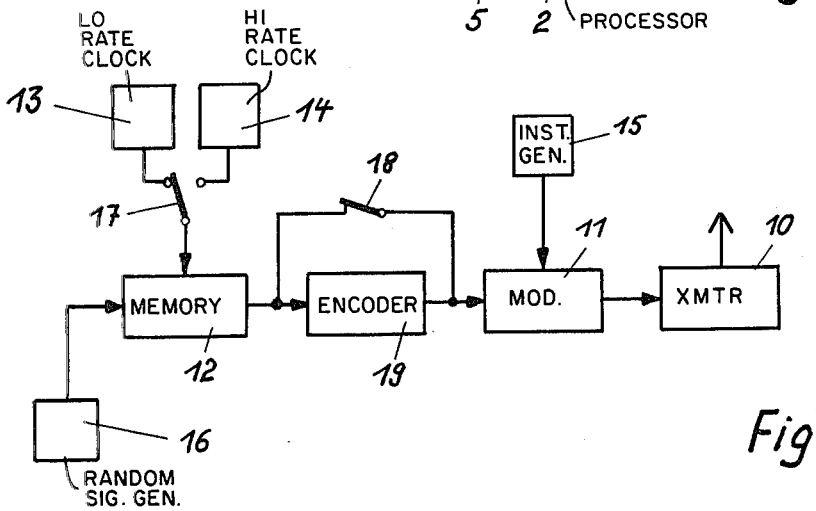
FIG. 2 is a schematic of the transmitter unit of the system of FIG. 1.

The transmitter unit 3 will be seen in more detail in the block schematic of FIG. 2, taking the form of one working example of the invention.

The transmitting unit 10, which is joined up with an antenna unit in line with the conditions of the place of use or locality in question, is responsible for radiating a signal modulated by modulator 11, which, when shorting switch 18 is shut, is supplied with information for modulation from information memory 12. The information memory or store 12 is best designed as a sequential input sequential output memory designed for giving a continuous output train of recurrent information.

When the shorting switch 18 is open, the information coming from information memory 12 is ciphered by undergoing arithmetic operations in an encoding unit 19. The ciphering memory, for example a programmable semiconductor memory is designed so as to be able to be exchanged for an other one for changing the ciphering effect.

Modulator 11 may furthermore be acted upon by an instruction generator 15, it then becoming possible for the receiver to be given certain, defined instructions for remote control.

For the transmission of information, it is possible to make use of carrier telegraphy, in which the two values 1 and $\phi$ of information memory 12 are made to take the form of two different modulation frequencies and, in this case, it is best to make use of a third frequency for instruction transmission, that is to say instruction generator 15 will be designed for producing this third frequency for remote control.

The data rate on output from information memory 12 is controlled, in a way dependent on the position of clocking speed change-over switch 17, by the low-rate clock 13 or the high-rate clock 14.

The information used for charging memory 12 comes from a random signal generator 16.

To make it more straightforward, FIG. 2 does not give any details of the central sequence control used in the transmitting unit. The sequence control may readily be designed by one trained in the art using currently marketed systems. The workings of such sequence control will be made clear later.

Figure 3:
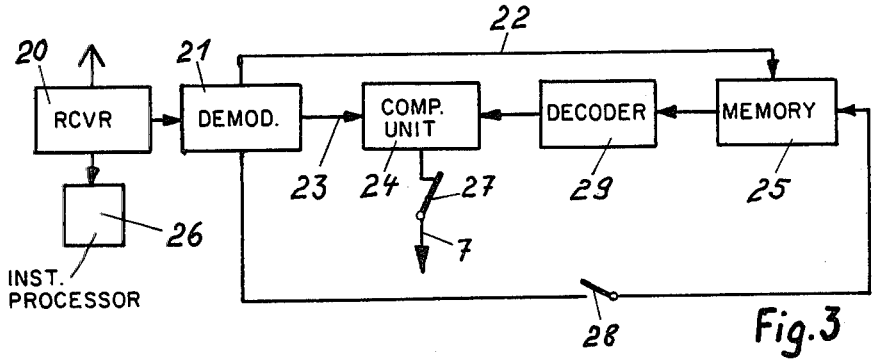
FIG. 3 is a view of the receiver unit of the system of FIG. 1.
Figure 4:
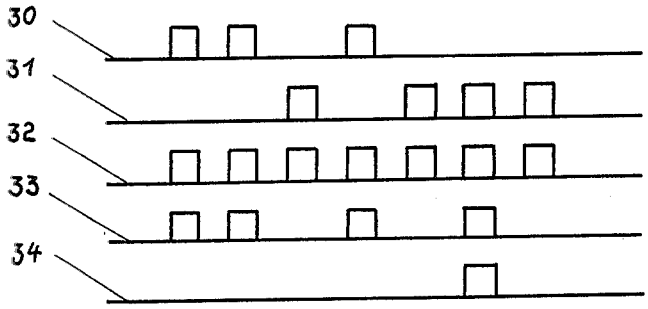
FIG. 4 is a diagram of pulses produced on operation of the system of FIG. 1.

The receiving and processing unit 5, 6 placed at container 2 will be seen in somewhat more detail in FIG. 3. Demodulator 21 is joined up with receiver unit 20 and is in a position of giving an output with a number of different signals, which may be seen, in part, in FIG. 4 in detail.

If the transmitting unit, as noted earlier, is designed for carrier telegraphy, in demodulator 21 the pulse trains or sequences of lines 30 and 31 will be produced, in each case, for one of the two frequencies used for such carrier telegraphy.

The pulse train 30 goes by way of information line 23 to comparison unit 24.

In demodulator 21, pulse train 32 is produced from the two pulse trains, this train 32 then going by way of clock line 22 to the information memory 25 as the clock frequency.

When the transmit switch 28 is turned on, a pulse train, representative of pulse train 30, will go to information memory 25 to be stored.

The information coming from information memory 25 goes by way of a decoder unit 29 to comparison unit 24 when switch 28 is opened (that is to say turned off).

Comparison unit 24 makes a comparison between information coming in by way of information line 23 and the information transmitted by way of decoder unit 29, bit-for-bit and once comparison unit 24 has sensed that the two forms of information are not in agreement with each other, it will be responsible for switching an instruction signal to output line 7, if arming switch 27 is turned on.

Receiver unit 20 is joined up or associated with a further demodulation unit, that is to say the instruction processing unit 26, designed for processing instructions radiated by the transmitter and supplying them then to the receiving unit's central control.

No detailed account will be given of this central control, which may readily be designed with components on the market, to make the present account more straightforward in other respects. The function of the central control will become fully clear, when looked at in the light of the function of the complete system, of which an account and description is to be given.

In FIGS. 2 and 3, mechanical switches 17, 18, 27 and 28 have only been marked by simple signs to make the schematic straightforward; in fact, the switching functions, for which they are responsible, may readily be undertaken by electronic components without changing, in any way, the general teaching of the system.

It has been noted earlier that the container 2 has a security apparatus of known design and which may be put into operation when needed. However, while in the prior art such security apparatus is generally put into operation by hand, for the automatic operation produced in the present invention, a change-round of the workings of the system for putting the security apparatus into operation, is necessary; that is to say the container's security apparatus is generally so designed and so joined up with the rest of the system that it is put into operation when such operation is not stopped by a special part of the system. Such suppression of operation, on the transport path to be protected by the invention, is undertaken by part of the system of the invention. Suppression of operation outside the transport path, that is to say at the position at which container 2 is filled, in transport vehicles and where container 2 is emptied, is undertaken by different systems, which may be readily designed using the teachings of the prior art. Such suppression system of mechanical or electromechanical design may, for example, be readily designed in combination with prior art mechanical locking parts of container 2 in the transport vehicle. In the simplest case, such mechanical locking parts may be used as well in the rooms in which container 2 is filled or emptied. If, as noted, these locking parts are fixedly joined up with the system suppressing operation of the security apparatus in the container 2, it will be seen that the security apparatus in the container will not be able to take effect as long as the containers are mechanically locked at the position of filling, in the transport vehicle or at the position of emptying. Such a mechanical or electromechanical system, joined with the mechanical locking parts, for suppressing operation of the container's security apparatus, will make such transport operation very much safer. It will be taken to be present in the following description of the workings of the system of the present invention.

It is furthermore possible for the receiving units 5, 6 and 7 to be placed in the lid of container 2 for the valuables and for the cut-off switch 27 to be so designed that it is only turned on after placing the lid on the container and an instruction being given by the transmitting unit. Normally, the lids of such containers are locked and unlocked with keys only given to certain persons in the filling and emptying rooms. When, for this reason, a container is opened in an emptying room, the lid will be disarmed and may be taken off without any special tool or the like. A special locking part, as noted earlier, will then not be necessary. The arming of switch 27 will take place again on putting on and locking the lid on the lines of the steps to be detailed later.

Dependent on the central controls of the transmitting and receiving parts, (which have not been put in FIGS. 2 and 3 for making them more straightforward) the parts of the system are then responsible for such functions that:

On filling in the position of filling, container 2 is mechanically locked and, for this reason, at the same time, operation of the container's security apparatus is stopped or suppressed. After container 2 has been filled and shut, the transmitting unit of FIG. 2 is switched on, this firstly causing information memory 12 to be charged with a random information train or sequence coming from random signal generator 16. On this operation clock speed change-over switch 17 is changed in position so that charging or recording takes place under the control of high-speed clock 14. The information memory 12 has a capacity of for example 10 Kbit and the high-speed clock 14 has a clocking frequency of 10 kHz so that the writing or recording operation takes place in one second.

At the end of recording, the transmitting unit is switched over to the "program transmit" mode. In this mode, the central control, not given in the figure, firstly sends a signal, produced by instruction generator 15, to the receiving station within container 2, the station processing the signal in the instruction processing unit 26 and sending it to the central control of the receiving station, the same effecting the shutting of switch 28 so that the received information goes from demodulator 21 to information memory 25 for storing or writing in.

Although the cut-off switch 27 is turned on, operation of the container's security apparatus is still suppressed by the mechanical locking of the container at the position of filling.

Switch 28 is kept turned on for a further time of about 1 second, this being caused by keeping on producing the instruction from instruction generator 15 for the time of information transmission, which now takes place, or by making such a design that the instruction generator 15 gives two different instructions, a start instruction and a stop instruction for the information transmission which then takes place.

When information is being transmitted, information memory 12, under the control of high-speed clock 14, sends out information by way of the encoding unit 19 to the modulation unit 11 and the transmitting unit 10.

At the receiving end the information received by receiving unit 20 is demodulated in demodulator 21 and by way of the turned-on switch 28 goes to information memory 25 in which it is stored or recorded.

The parallel clocking pulses for the information memory comes from demodulator 21 and is transmitted by way of clock line 22 to the information memory 25.

By the time information transmission has run to an end, all the information (although it will, however, have been ciphered in the ciphering unit 19) of information memory 12, will have been handed over and recorded in information memory 25.

The next step is that of switching over the transmitting unit to the "run" mode, in which respect, by switching over the clock speed change-over switch 17, the information memory 12 is now worked with the slow speed clock rate of clock 13. Furthermore, because of the turning on of shorting switch 18, the encoding unit 19 no longer has any effect with respect to information going to the transmitting unit 10.

By turning on the low-speed clock 13, the transmitting rate is decreased to, for example, 10 pulses/sec. The information sent out by the transmitting unit 10 and received by receiving unit 20 is demodulated in demodulator 21 and the 1-pulses 30 go by way of information line 23 to comparison unit 24. The clock frequency 32 produced at the same time in the demodulator unit 21 goes by way of clock line 22 to information memory 25, now reading out the information stored in it by way of the decoder unit 29 so that it goes to comparison unit 24 as well.

By way of the decoding unit 29, from the information coming from information memory 25, a form of information is produced which bit-for-bit is in full agreement with the first form of information of the information memory 12; that is to say the coding unit 19 and the decoding unit 29 make use of the same algorithm and the same cipher information in the opposite direction.

The comparison unit 24 makes a comparison between these two forms of information bit-for-bit and, if they are in agreement with each other, no signal is sent by comparison unit 24 by way of arming switch 27, this stopping or suppressing any operation of the security apparatus of container 2.

It is now possible for container 2 to be freed from its mechanical locking system without there being any chance of its security apparatus being put into operation on undoing the locking system. The container 2 is now transported along the transport path 1, it being within the range of the high frequency field of transmitting unit 3 all the time so that, because of the effect of the systems of FIGS. 2 and 3, there is no chance at any time of the container's security apparatus being put into operation. If, on the other hand, container 2 is taken out of the high frequency field of the transport path 1, information will no longer be received coming from the transmitting unit 3 and, in this case, comparison unit 24 will make out that there are no longer two sorts of information in agreement with each other and will send out a signal, by way of arming switch 27, for putting the container's security apparatus into operation. The process of operation will be seen schematically in FIG. 4. Comparison takes place between information 30 coming in by way of information line 23 and information 33 coming in by way of the decoding unit 29. It will be seen from FIG. 4 that for one bit of information 33, there is no parallel bit in information 30 so that, for this reason, an instruction 34 is produced for causing operation of the container's security apparatus.

In the case of the transmitting frequency of 10 Hz used in the system, the memory capacity given only by way of example, of the two information memories 12 and 25 of, in each case, 10 Kbit will be long enough for a transport time of about 15 minutes, long enough for covering most transport operations of the sort in question.

The transport operation noted here will come to an end when the container 2 is placed in the transport vehicle with its own security system. Here container 2 is placed in the locking systems noted earlier so that, at the same time, any putting into operation of the container's security apparatus will be made impossible mechanically or electromechanically.

After locking container 2 in the transport vehicle, the transmitting unit 3 may be turned off.

As will be seen from the account given, it is necessary to take steps to see that the high frequency field gets to the container till it is safely placed in the locking system in the transport vehicle, as otherwise there would be the danger of receiving coming to an end before the container has been taken as far as the transport vehicle. The steps for doing this are parking the transport vehicle well within the range of the transmitting unit and possibly making use of further electronic systems, in the vehicle itself as well.

In the working example of the invention so far outlined, in which the receiving system 5, 6 and 7 is placed in the lid or cover of container 2, the stages of operation in the systems used may usefully be caused to take place differently by making changes in the design of the central control. A description will now be given of a way in which the apparatus is so worked that more than one container may be filled, transported or emptied at a time.

The transmitting unit 3 is switched on before filling or emptying or right after the arrival of the vehicle and is kept in operation all the time the transport operation is going on. The information memory 12 is charged. The transmitting unit 3 becomes switched over to "run", which is interrupted automatically frequently by being switched over to "program transmit".

In the "program transmit" mode after the get-ready instruction as noted, the information recorded in information memory 12 (which, as may be noted, takes the form of a shift register) is transmitted starting with the information part, which would have been transmitted in the "run" mode if there had been no interruption. After one complete cycle of the information memory 12, the instruction "end of transmit" is produced and then the system goes back into the "run" mode for transmitting the information of information memory 12 starting at the point coming before the interruption.

A receiving system which is enabled in this way as noted by putting on and locking the lid on container 2 is not acted upon by the information transmitted till the get-ready signal is produced and after this, the information from information memory 12 will, as we have seen, be taken up in information memory 25.

The stop instruction is responsible for producing at the receiving end the steps noted for going over into the "run" mode, switch 27, which has so far been locked, then being freed. Container 2 is now protected for transport. At the same time, any further processing of the get-ready instruction is suppressed.

The receiving system 5, 6 and 7 keeps in this condition till the container has been placed in the locking mechanism in the transport vehicle, or till the lid is unlocked.

The unloading operation takes place generally on the same lines with the opposite order of steps. Taking the case of using a transmitting unit as in FIG. 2 at the position of unloading for giving protection along the complete transport way (or path) from the transport vehicle to the position of emptying, after the arrival, parking and opening of the transport vehicle, this transmitting unit is switched on and in the way given, at the same time, the information memory 12 is charged with a program.

On moving the mode switch into the next position, this program is encoded in the way noted and is recorded in the information memory 25 of container 2.

In the next position of the mode of operation switch, sending and receiving operations are started and, by way of arming switch 27, any putting into operation of the container's security apparatus is suppressed. The container 2 may now be pulled clear of its locking system or catch and taken out of the transport vehicle, transported along the transport path and snapped into the locking system or catch in the emptying or unloading room.

After this locking system has taken over the function of suppressing the instruction which would otherwise put the container's security apparatus into operation, the transmitting unit may be turned off again.

In the second further example of the invention, these steps are undertaken on generally the same lines.

Such transport vehicles are frequently designed with a keyboard for the driver's use, with which the separate containers may be freed so that they may be taken from their locks or catches. After switching on the transmitting unit, a useful effect is produced, if this keyboard is armed by an unlock instruction. By using a carefully thought-out organization, it is even possible for the keyboard to be cut out of the system and then the containers, which are to be unloaded, may be unlocked by instructions from the transmitting unit.

Once this is done, the program is transmitted in the way noted.

For making good use of the vehicle for increasing the security of the transport path, it is best for the vehicle to have an antenna and its own receiver, from which the containers may be supplied by way of wiring while they are locked in a frame.

It is best for the information of only one memory to be transmitted in the transport time so that the information of the memory is only once used. In field use, however, longer transport times will be possible, because the two information memories are designed as shift registers with repetitious readout of the information therein sequentially.

Figure 5:
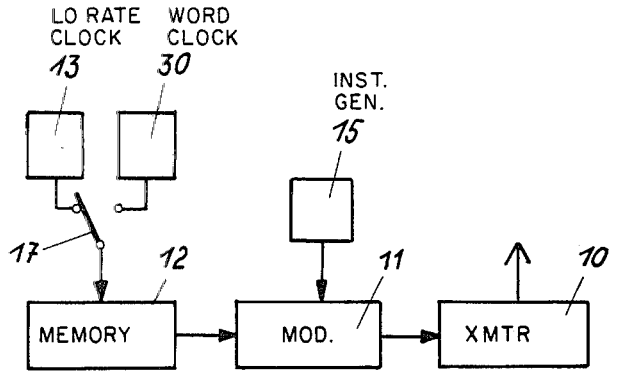
FIG. 5 is a view of a somewhat changed form of the transmitter unit of FIG. 2.
Figure 6:
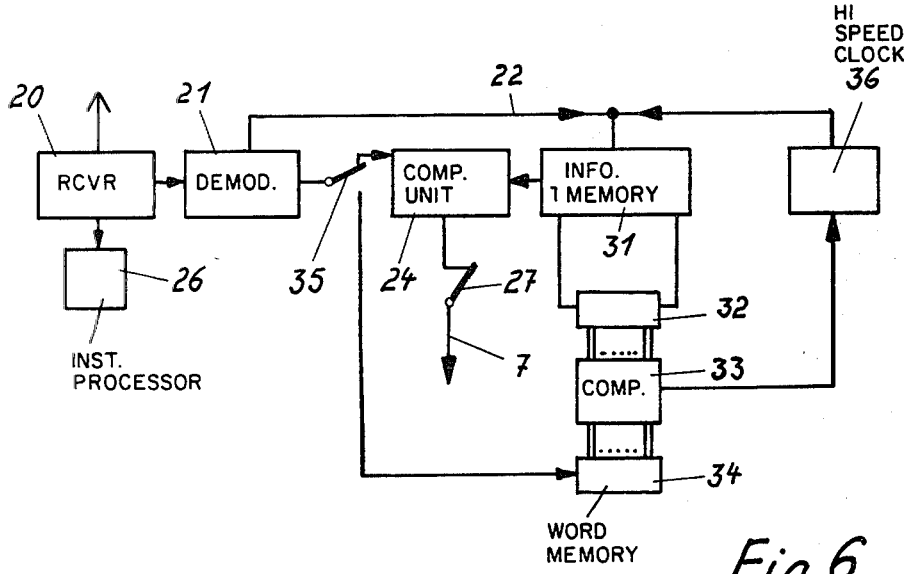
FIG. 6 is a somewhat changed form of the receiving unit of FIG. 3.

A further working example of the invention is to be seen in FIGS. 5 and 6, which makes use of the same monitoring or watching teaching, together with a great number of the components as used in FIGS. 2 and 3 so that, details of this further form of the invention may in part be taken from the description of FIGS. 2 and 3.

The transmitting unit of FIG. 5 is different from that of FIG. 2, more specially, because there is no encoding unit 19 and furthermore no random signal generator 16 is needed. Furthermore, the place of the high-speed clock 14 has been taken by the word clock 30, used for causing the readout of bit sequences of a given length from information memory 12.

In the receiving unit of FIG. 6 as well, there is no decoding unit 29 as used in the receiving unit of FIG. 3. The information memory 31 is used as a shift register like the information memory 25, it being different because it has one parallel output 32 for a given number of bits, that is to say for a word, the output 32 going to a word comparison unit 33. The information memory 31 may furthermore be clocked by way of a high speed clock 36 as well as by way of the clock line 22.

The output of demodulator 21 is joined with an information change-over switch 35 which makes it possible for the information to be supplied to a word memory 34 and not to comparison unit 24, memory 34 having, as well, a parallel output joined with word comparison unit 33. The latter has an instruction output with which high-speed clock 36 may be interrupted.

The form of the invention to be seen in FIGS. 5 and 6 is more vastly different from that noted in connection with FIGS. 1 to 4 in that the information in the information memory is not newly formed on each transport operation and, in fact, it is recorded in the memories which are in the form of programmable semiconductor memories with the same information in them, this information being used for all parts of the system used for a transport operation, that is to say at least for the transmitting unit at the position of filling, the transmitting unit at the position of emptying and for the receiving unit in container 2.

In the case of the transmitting unit, the "information transmit" mode has its place taken by a "synchronize" mode which is put into operation on the same lines as noted earlier, by a special instruction coming by way of instruction generator 15 and instruction processing unit 26, in which a central control, not given in the schematics, is put into operation.

In this mode by switching over clock speed change-over switch 17 to the word clock 30, the transmission of a word, that is to say for example of a chain of 14 bits, is started.

In the same mode, the information switch 35 is so switched over that the transmitted word is recorded in word memory 34. Furthermore, the same mode has such an effect that, with the help of the high-speed clock 36, the information of memory 31 is shifted at a high speed. Taking it that the memory has the same data as given earlier, a memory cycle takes less than one second.

In this time, word comparison unit 33 will be making comparison, without stopping, to see if the word at parallel output 32 is in agreement with (namely, the same as) the word supplied by the transmitting unit to the word memory 34.

When the words are in agreement, the high-speed clock 36 will be stopped by it and, for this reason, any further shifting of information in memory 31. Now the two sorts of information in information memories 12 and 31 are in step or synchronized and the normal mode of operation for protecting the transport path may be started.

Further operations take place in quite the same way as the operations we have noted earlier. On the same lines, it is necessary for the synchronizing stage, for getting the two systems in step, to be undertaken not only on transport of the container 2 to the transport vehicle, but furthermore on transport therefrom.

The information, which as far as possible will be stochastic in nature and be stored in programmable semiconductor memories, that is to say information memories 12 and 31, is best or preferably changed over at certain regular points in time, for example every day, by changing over the memories, taking care to see that all transmitting and receiving units, forming part of the system, get the same information.

With respect to the design of the information components, care is furthermore to be taken that, as part of the stored information, there is no repetition of words. Taking it that the information is generally stochastic in form and that the data as noted is kept to, there will be little chance of any such word repetition. However, dependent on the way the information memories or components are produced, special testing processes will have to be used to make certain that there is no chance whatever of such undesired repetition.

The working example of the invention last noted, may be made simpler if the information sequence, used for the transport protection, undergoes division into sections (which do not have to be of equal length) each of these sections starting with a section number. This section number has to be markedly different from the rest of the information. No two section numbers are to be the same. For this purpose, it is possible, for example, in registering the section numbers, to make use of a special code-form, not used in the rest of the information, or for the section numbers to be clearly marked by starting with an instruction to go over to a different frequency.

In this simpler form of the invention, information transmission by the transmitting unit will be started in each case with a section number. In the synchronizing stage coming beforehand, steps will be taken to see that in the information memory 31 as well, the same section number is at the start of transmission.

This last working example of the invention is better in some respects than the other working examples and worse in others. One shortcoming is that the information, used for protection of transport, has to be produced at the start in the form of semiconductor components so that there is a danger of persons copying such information and making use of it without authority.

The system is more useful because no transmission for storing is needed, which would otherwise take up time in addition to the time of operation of the protective system.

Such transmission stages may be picked up by criminals and misused.

In certain forms of the transport path, (taking into account, for example, conditions such as length in a particular direction), the size of the high frequency field used for security purposes may be specially important. In such cases, steps may be necessary to see that the high frequency field is not radiated out past the transport path as such or may not be deflected away from the transport path by criminals, and moreover for producing better concentration of the high frequency field, known technical processes, more specially, homing beam systems may be used. In such known processes, a certain path curve—generally one axis of symmetry of the antenna system used—at which there is an unchanging field strength, even though there is a switch over of separate antennas of an antenna system. It is then readily possible for the high frequency energy used for protecting transport to be radiated using such an antenna system with antennas able to be switched over and to undertake, at the receiving end, further monitoring of the high frequency energy which changes with the switching over frequency. For this reason, it will be possible, particularly in the case of long transport paths clear of buildings or the like, for the transport beam (produced by the process) to be made specially narrow.

I claim:

1. In an anti-theft system for the transport of a container for valuables along a short path between a safe and a waiting valuables transport vehicle, said system having a transmitting unit, separate from said container, for transmitting signals able to be received by a receiving unit on said container, and having a security apparatus designed to be put into operation when said receiving unit receives no signal, the improvement comprising:

a first memory in said transmitting unit, a second memory in said receiving unit, for cooperating with said first memory, an information generator, whose information may be recorded by said first and second memories, a comparison unit at said container for comparison of said information as sequentially read out from said two memories and for causing operation of said security apparatus when said information from one memory is not in agreement with said information from said other memory.

2. The structure as claimed in claim 1, wherein said security apparatus is designed for effecting an operation selected from the group: marking the valuables to make them useless, destruction of said valuables, giving an alarm signal.

3. The structure as claimed in claim 1, wherein said information generator is designed for producing random signals, said random signals being stored in said second memory of said receiving unit before each transport operation.

4. The structure as claimed in claim 3, wherein said recording of said random signals takes place at a data rate controlled by a clock frequency and said readout, by way of said transmitting unit from said second memory, takes place under the control of a clock frequency, the clock frequency on storing in said memories being higher than on readout.

5. The structure as claimed in claims 1, 2, 3 or 4, further comprising at least one directional antenna, the radiation therefrom being generally limited to the transport path.

6. The structure as claimed in claims 1, 2, 3, 4 or 5, comprising mechanical locking parts placed at the two ends of the transport path for locking onto the container and so suppressing operation of said security apparatus.

7. The structure as claimed in claims 1, 2, 3 or 4, wherein said transmitting unit and said receiving unit are designed for operation in the modes "transmission of information", "run", the mode being able to be changed from the transmitting unit.

8. The structure as claimed in claims 1, 2, 3 or 4, wherein the signals transmitted from the transmitting to the receiving units are high-frequency radio signals.

9. The structure as claimed in claims 1, 2, 3 or 4, wherein one of the ends of said path is in said vehicle and wherein said vehicle has an outside antenna and its own receiver joined by wiring with said locking parts, said receiver on said vehicle getting signals from said stationary transmitter.

10. In an automatic anti-theft system for transport paths, on which valuables containers are transported which have a security apparatus for taking steps when the container gets into the hands of a person acting without authority, the improvement comprising:

at least one stationary transmitting unit, said unit producing an energy field for covering said transport path to be protected, a receiving unit on said container and designed for receiving said energy field, produced by said transmitting unit, and a unit stopping operation of said security apparatus as long as a given program is received, said transmitting unit having a first information memory and modulation units, with which the radiated energy is modulated, said receiving unit having a second information memory and a checking system for checking the modulation of said received energy.

11. The structure as claimed in claim 10, further comprising a random signal generator in said transmitting unit and designed for producing stoichastic information for recording in said information memories before each such transport operation.

12. The structure as claimed in claim 10, further comprising an encoding unit in said transmitting unit for encoding the information from said first memory on transmission of said information before a transport operation, and a decoding unit in said receiving unit for decoding the encoded information of said second information memory at the time of transport.

13. The structure as claimed in claim 10, further comprising a high speed clock for controlling the rate of transmission of the encoded information before a transport operation.

14. The structure as claimed in claim 10, further comprising an instruction generator in said transmitting unit, and an instruction processor in said receiving unit for supply of mode instructions.

15. The structure as claimed in claim 10, further comprising a word clock in said transmitting unit, and a word memory in said receiving unit for the transmitting and storing of a part of given length of the information in said first and second memories, respectively.

16. The structure as claimed in claim 15, wherein said second information memory of said receiving unit has a parallel output and a comparison unit, which, on agreement between information offered by said first information memory and information taken from said word memory has the effect of stopping information cycling as produced by a high-speed clock so that the information output from the information memories is in step.

17. An anti-theft system for protection of paper money while being transported in a container along a short path between a container filling point, and a vehicle designed for money transport comprising, a stationary transmitting unit having a limited transmitting range, a first read-out memory wired to said transmitting unit, a random signal generator wired to said transmitting unit, and providing information for charging said first read-out memory, a receiving unit on said container for receiving signals transmitted by said transmitting unit, and originating in said random signal generator, a demodulator for demodulation of signals received by said receiving unit, a second read-out memory wired to said receiving unit for storing demodulated signals received from said demodulator, a comparison unit for comparing the signals read out sequentially from said second memory, with signals coming from said transmitting unit, a security apparatus on said container for marking and making said paper money useless for unauthorized persons, said security apparatus associated with said comparison unit for operation by the same, a clock apparatus wired to said transmitting unit for cooperation with said receiving unit, and designed for producing two clock rates for operation of said two memories at two different data rates, that is to say, at a high data rate for storing random signal data in said two memories simultaneously, before the start of transport along said short path, and at a low data rate for read-out from said two memories during transport of said paper money along said path, and a central control acting as a remote control apparatus by way of said receiving unit, for effecting operation of the anti-theft system in the modes:

(1) an information storing mode in which random signals from said random signal generator are stored at said high data rate in said two memories before transport along said short path of said paper money, and (2) a run mode with read-out of information from said second memory at said container, and signals from said first memory wired to said transmitting unit, as transmitted to said container, for comparison with each other, said comparison unit producing a signal for operation of said security apparatus, if said receiving unit is moved out of the transmitting range of said transmitting unit.

* * * * *